US008118977B2

(12) United States Patent
Denk et al.

(10) Patent No.: US 8,118,977 B2
(45) Date of Patent: Feb. 21, 2012

(54) DRYER SECTION IN A PAPER MACHINE

(75) Inventors: Wolfgang Denk, Wieselburg (AT); Norbert Karner, Krummnussbaum (AT)

(73) Assignee: Voith Patent GmbH, Heidenheim (DE)

( * ) Notice: Subject to any disclaimer, the term of this patent is extended or adjusted under 35 U.S.C. 154(b) by 316 days.

(21) Appl. No.: 12/393,610

(22) Filed: Feb. 26, 2009

(65) Prior Publication Data

US 2009/0173468 A1 Jul. 9, 2009

Related U.S. Application Data

(63) Continuation of application No. PCT/EP2007/060295, filed on Sep. 28, 2007.

(30) Foreign Application Priority Data

Oct. 30, 2006 (DE) ..... 10 2006 051 051

(51) Int. Cl.
*D21F 5/02* (2006.01)
*F26B 13/18* (2006.01)

(52) U.S. Cl. ..... 162/193; 162/375; 162/207; 226/172; 34/117

(58) Field of Classification Search ..... 162/207, 162/375, 194, 193, 306; 226/191, 195, 170–172; 34/116, 117, 123, 623
See application file for complete search history.

(56) References Cited

U.S. PATENT DOCUMENTS

| | | | | |
|---|---|---|---|---|
| 5,426,867 | A | 6/1995 | Yli-Kauppila et al. | |
| 5,661,911 | A * | 9/1997 | Yli-Kauppila | 34/117 |
| 5,921,000 | A * | 7/1999 | Wedel et al. | 34/117 |
| 6,365,004 | B1 | 4/2002 | Hamstrom et al. | |

FOREIGN PATENT DOCUMENTS

| | | | |
|---|---|---|---|
| DE | 10 2004 017 810 | A1 | 10/2005 |
| DE | 10 2004 017 811 | A1 | 10/2005 |
| WO | WO2005068713 | A1 | 7/2005 |

* cited by examiner

*Primary Examiner* — Eric Hug
(74) *Attorney, Agent, or Firm* — Taylor IP, P.C.

(57) ABSTRACT

An apparatus for handling a moving material web includes: a treatment unit including a rotating conveyor belt which forms a closed loop and carries the material web; a second treatment unit with a second conveyor belt which also forms a closed loop, both treatment units being connected parallel relative to each other; a first switch-over for the transfer of the web from the first to the second conveyor belt; and a second switch-over unit for the transfer of the web from the second to the first conveyor belt.

5 Claims, 3 Drawing Sheets

DRYER SECTION IN A PAPER MACHINE

CROSS REFERENCE TO RELATED APPLICATIONS

This is a continuation of PCT application No. PCT/EP2007/060295, entitled "DRYING SECTION OF A PAPER MACHINE", filed Sep. 28, 2007, which is incorporated herein by reference.

BACKGROUND OF THE INVENTION

1. Field of the Invention

The invention relates to a dryer section in a paper machine or in a cardboard machine or other machine for drying a moving web, especially a fibrous web.

2. Description of the Related Art

Dryer sections of this type are known in a plurality of design forms. See U.S. Pat. No. 6,365,004 B1, WO 2005/068713 A1, DE 10 2004 017 810 A1 and DE 10 2004 017 811 A1.

Known dryer sections are constructed as follows: they include a first row of dryer cylinders, and also a second row of dryer cylinders below the first row. The two rows generally progress parallel to each other and in horizontal direction. The dryer cylinders of one row are staggered relative to the dryer cylinders of the other row. All dryer cylinders are wrapped by a water vapor-permeable woven fabric belt, for example a dryer felt. The woven fabric belt represents a closed loop and rotates during the operation of the dryer section. At the same time the woven fabric belt carries the material web, for example a paper web which is to be dried. The web alternately is in direct contact with the surface area of a dryer cylinder and is enveloped by the fabric belt, while on the subsequent cylinder it lays freely on the fabric belt.

Frequently several dryer groups are provided. Viewed in direction of web travel these dryer groups are arranged in tandem. This has the advantage that a variety of influences can be exerted upon the web during the course of its travel through the entire dryer section.

The web is to be transferred from one dryer group to the subsequent one. The transfer may be accomplished such that the web is not exposed at any time and such that it is however sandwiched between the fabric belt of a first dryer group and the fabric belt of the subsequent second dryer group.

There are however also situations where the enclosed web transfer is not possible due to constructive or spatial reasons, so that the web must be transferred exposed and unsupported from one dryer group to the subsequent one. The web is subject to a certain tensile stress in longitudinal direction. In an exposed transfer one refers to exposed web segments. Exposed web segments are neuralgic locations, because of potential web breaks.

The danger of web breaks at exposed web segments depends on various factors. Papers having a high basis weight dry slower than papers which have a low basis weight. The dryer section in the paper machine however has only a certain drying capacity. This may be sufficient for papers having a low basis weight, however the tensile strength of such papers is also naturally lower.

It would therefore be desirable to adapt the drying capacity of the web to the prevailing conditions, thereby giving more consideration to different paper characteristics such as basis weight, tensile strength, etc. However, this is not possible.

What is needed in the art is to create a dryer section in a paper machine so that it is adaptable to varying requirements with regard to the web which is being processed, as well as to other influences. Exposed web segments should also be avoided. Ultimately, an existing dryer section should be able to be retrofitted accordingly.

SUMMARY OF THE INVENTION

The present invention provides an apparatus for handling a moving material web, including: a treatment unit including a rotating conveyor belt which forms a closed loop and carries the material web; a second treatment unit with a second conveyor belt which also forms a closed loop, both treatment units being connected parallel relative to each other; a first switch-over for the transfer of the web from the first to the second conveyor belt; and a second switch-over unit for the transfer of the web from the second to the first conveyor belt. Accordingly, a second lower dryer group is provided in addition to the at least one first upper dryer group of a dryer section. This includes at least one dryer cylinder as well as a second vapor permeable fabric belt which forms a closed loop and wraps around the dryer cylinder or dryer cylinders respectively. Generally, several guide rollers will be provided. During operation of the dryer section the second fabric belt is driven in opposite direction to the direction of the first dryer group.

The most important characteristic consists in that measures are taken to bring the two fabric belts toward each other at two different locations in the web path. At the two transfer locations the two fabric belts progress in the same direction and at the same speed. The material web which is to be transferred is sandwiched between the two fabric belts over a brief period of time. Consequently there is no exposed web segment so that there is no danger of a web break. The two fabric belts—the one of the first upper dryer group, as well as the one of the second lower inventive dryer group—can however also be again directed away from each other.

The inventive additional dryer group is connected parallel to the conventional first dryer group. It serves so to speak as a by-pass. It may be connected or disconnected as required, depending upon the aforementioned requirements with regard of the web which is being processed.

It is not critical as to how the dryer groups—the conventional upper or the inventive lower—can be configured. For example, the first or the second dryer group may include an upper and a lower row of dryer cylinders. Both dryer groups may however also include an upper row of dryer cylinders and a lower row of suction rolls. Other additional dryer equipment is also feasible, for example infrared dryer sections, hot air drying equipment, and others.

It is also irrelevant whether the woven fabric belt of the inventive dryer group is brought to the fabric belt of the conventional dryer group, or vice versa.

One interesting configuration consists of an arrangement whereby the transfer locations are variable. For example, the upstream transfer location could be positioned at alternating locations.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one embodiment of the invention, and such exemplifications are not to be construed as limiting the scope of the invention in any manner.

DETAILED DESCRIPTION OF THE INVENTION

Figure 1:
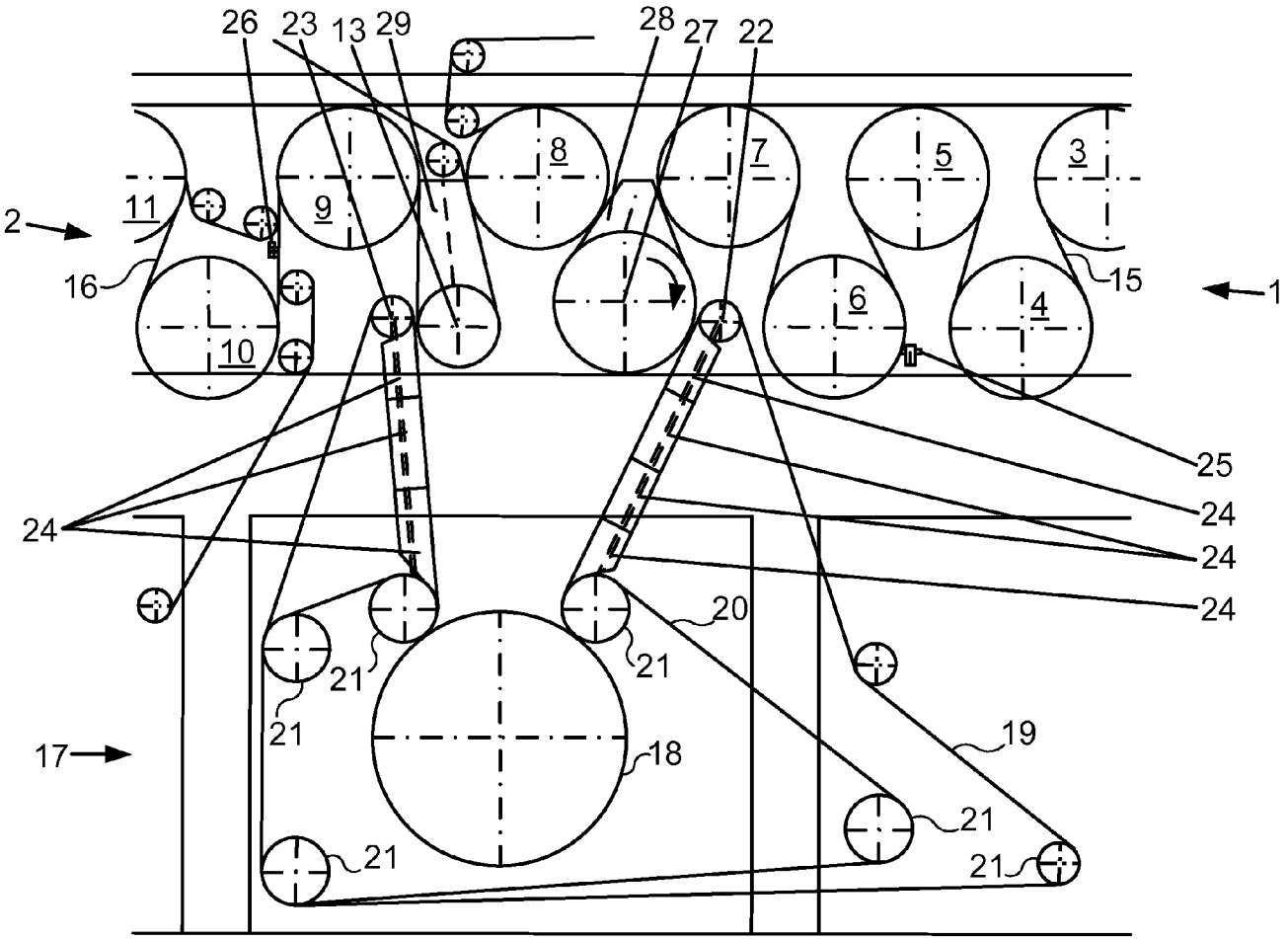
FIG. 1 is illustrates the referred to subject with connected additional dryer group.

Referring now to the drawings, the conventional dryer section is always on top. It comprises two dryer groups—one dryer group 1 and one dryer group 2. The dryer group 1 includes dryer cylinders whereby the dryer cylinders 3 through 8 are visible. A stabilizer roll 27 with a stabilizer box 28 is located between the dryer cylinders 7 and 8. The second dryer group 2 also includes dryer cylinders whereby the dryer cylinders 9 through 11 are visible. In addition, a suction roll 13 is part of the second dryer group 2, and several guide rollers are part of both dryer groups 1, 2.

The dryer group 1 includes a dryer fabric 15, and the dryer group 2 includes a dryer fabric 16.

The inventive dryer group 17 is located below the two dryer groups 1 and 2. This is arranged predominantly in the basement of the paper machine. It includes one dryer cylinder 18, in addition one dryer fabric 19, as well as one dryer fabric 20.

The two dryer fabrics 19 and 20 wrap around numerous guide rollers 21, in addition two pivoting guide rollers 22, 23.

In addition the dryer group 1 includes a cut-off device 25, and the dryer group 2 includes a web tear sensor 26 which controls the cut-off device 25.

The web which is to be dried travels into the dryer group 1—as seen in the drawing—from right to left. See arrow on stabilizer roll 27. At the drying cylinder 3 the web is held sandwiched between the surface area of the cylinder and the dryer fabric 15. At the dryer cylinder 4 it is outside, and the dryer fabric 15 is located between the surface area of the dryer cylinder 4 and the web.

At the dryer cylinder 5 the paper web is again located between the surface area of said cylinder and the dryer fabric 15, and so on.

The stabilizing roll 27 is a suction roll with a bored roll sleeve and with a suction connection. Likewise, the areas which are in contact with the dryer fabric 15 are equipped with perforations. The surfaces of the stabilizing box 28 which are in contact with the web are also perforated, and a suction unit is also allocated to the stabilizing box 28. In the configuration according to FIG. 1 where the inventive additional dryer group 17 is connected, neither the stabilizing roll 27 nor the stabilizing box 28 are equipped with suction. The web which is on the outside of the stabilizing roll 27 is now admitted from the dryer fabric 15 onto the dryer fabric 19 of the dryer group 17. Dryer fabric 19 glides over the first stabilizing elements 24. Then the dryer fabric 19 with the web on it arrives at the dryer cylinder 18. There it is enveloped between the surface area of the dryer cylinder 18 and the second dryer fabric 20, as well as the first dryer fabric 19.

After traveling around the dryer cylinder 18 the web travels over the second group of stabilizing elements 24. At the pivoting guide roller 23 it is transferred to the dryer fabric 16 of the dryer group 2. In this area the dryer fabric 16 glides over an additional stabilizing box 29. This, again, is equipped with perforated gliding surfaces. In the example according to FIG. 1 it is equipped with suction, so that the web is transferred positively from the dryer fabric 19 to the dryer fabric 16.

The two stabilizing boxes 28 and 29 are positioned longitudinally—see the perforated lines. The two components of the aforementioned stabilizing boxes 28 and 29 can therefore be supplied independently from each other with suction.

The individual stabilizing elements 24—the ones depicted on the right, as well as those on the left—can be supplied at different levels of suction. For example, the lower one of the stabilizing elements 24 depicted on the right is operated at a higher vacuum in the configuration according to FIG. 1. Its function is to reduce the dragged along air volume in the clothing. Another option is to use a steam blow box in this area.

Figure 2:
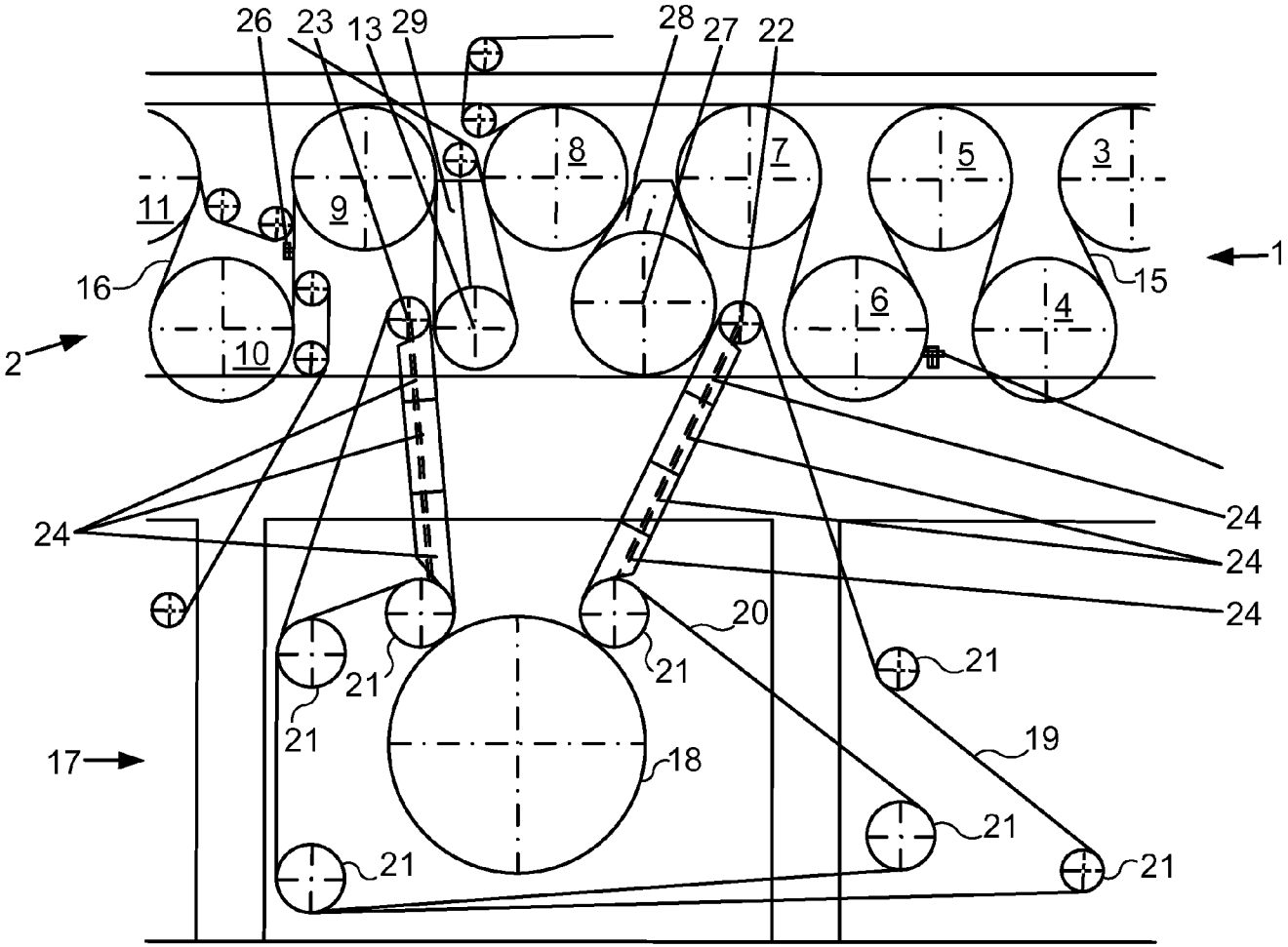
FIG. 2 illustrates the referred to subject with disconnected additional dryer group.

The guide roll 22 and the stabilizing elements 24 depicted on the right are structurally connected with each other. These aforementioned components—guide roller 22 and the associated stabilizing elements 24—can be pivoted together, so that they assume either the closed configuration depicted in FIG. 1, or the open configuration depicted in FIG. 2.

The same applies to the pivoted guide roller 23 with the stabilizing elements 24 depicted on the left.

The invention has general application, and not only for the dryer section of a paper machine.

The invention may generally be utilized in an apparatus for the treatment of a moving material web. The apparatus includes a first treatment unit including a conveyor belt which forms a closed loop and carries the material web.

Figure 3:
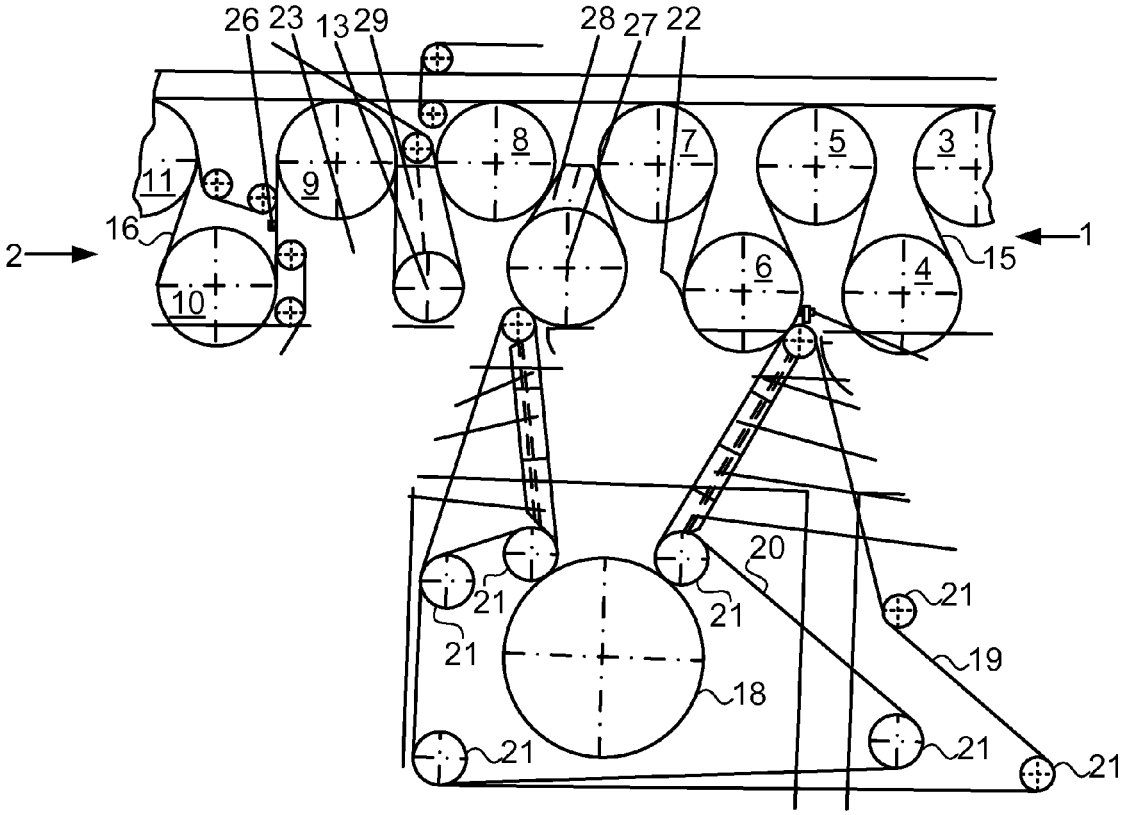
FIG. 3 shows another embodiment of the present invention with connected additional dryer group.

According to the current invention a second treatment unit is provided which includes a second conveyor belt which also forms a closed loop. In addition, the two treatment units are parallel connected. Finally, a first switch-over is provided with which the material web can be transferred from the first to the second conveyor belt and a second switch-over with which the material web can be transferred back from the second conveyor belt to the first conveyor belt (see, for example, FIG. 3).

One could refer to this as a kind of bypass shifting arrangement.

One interesting deviation from the basic concept consists in that the upstream transfer location for the transfer from the first conveyor belt (dryer fabric) to the second conveyor belt (dryer fabric) can be freely selected.

In the illustrated design example this variation consists in that the guide roller 22 can be pivoted not only between the dryer cylinder 6 and the stabilizing roll 27, but also (in addition) at a different location, for example in the area of the dryer cylinder 4.

The same applies to the pivoted guide roller 23.

In general one would strive to keep the distance between the two pivoted guide rollers 22, 23 as small as possible, relative to the path of the web between the two transfer locations. In the configuration according to FIG. 1 everything belonging to the upper dryer group 1 and 2 is not used for drying.

In the illustrated design example the "switch-over", in other words the transfer location from the two upper dryer groups to the lower inventive additional dryer group, is located on top. However, this could also be reversed. The transfer locations could therefore also be located on the lower dryer group.

It is understood that the lower dryer group may include more than only one single dryer cylinder.

COMPONENT IDENTIFICATION

1 Dryer group
2 Dryer group
3 to 8 Dryer cylinder

9 to 11 Dryer cylinder
13 Suction roll
14 Guide rollers
15 Dryer fabric
16 Dryer fabric
17 Dryer group
18 Dryer cylinder
19 Dryer fabric
20 Dryer fabric
21 Guide rollers
22 Pivoted guide roll
23 Pivoted guide roll
24 Stabilizing element
25 Cut-off device
26 Tear sensor
27 Stabilizing roll
28 Stabilizing box
29 Stabilizing box While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An apparatus for handling a web of fibrous material which is moving, said apparatus comprising:

a first treatment unit including a rotating first conveyor belt which forms a first closed loop and is configured for carrying the web, said first treatment unit including a rotating additional conveyor belt which forms an additional closed loop and is configured for carrying the web;

a second treatment unit including a second conveyor belt which forms a second closed loop, said first and second treatment units being connected parallel relative to each other;

a first switch-over configured for transferring the web from said first conveyor belt to said second conveyor belt; and a second switch-over unit configured for transferring the web from said second conveyor belt to said additional conveyor belt.

2. A dryer section in a paper machine, said dryer section comprising:

a first top dryer group including a vapor permeable first woven fabric belt and at least one of a first plurality of dryer cylinders and a first plurality of rolls, said vapor permeable first woven fabric belt wrapping around said first plurality of dryer cylinders and forming a first endless loop;

a second top dryer group including a vapor permeable additional woven fabric belt and an additional plurality of dryer cylinders, said additional woven fabric belt wrapping around said additional plurality of dryer cylinders and forming an additional endless loop;

a lower dryer group connected parallel to said at least one top dryer group, said lower dryer group including a vapor permeable second woven fabric belt and at least one of a second plurality of dryer cylinders and a second plurality of rolls, said vapor permeable second woven fabric belt wrapping around said second plurality of dryer cylinders and forming a second endless loop, said first and second woven fabric belts being driven in opposite directions relative to one another, one of said first and second woven fabric belts configured for being positionable and thereby for being moveable to the other of said first and second woven fabric belts at an upstream first transfer location, one of said second and said additional woven fabric belts configured for being positionable and thereby for being moveable to the other of said second and additional woven fabric belts at a downstream second transfer location.

3. The dryer section according to claim 2, wherein said upstream first transfer location includes a first guide roller, said downstream second transfer location including a second guide roller, each of said first and second guide rollers being located in said second endless loop of said second woven fabric belt of said lower dryer group and being configured for being one of moved and pivoted in order to open and close a path of a web of fibrous material.

4. The dryer section according to claim 3, further comprising a first stabilizing section and a second stabilizing section, said first stabilizing section being located after said first guide roller at said upstream first transfer location, said second stabilizing section being located before said second guide roller at said downstream second transfer location.

5. A dryer section in a paper machine, said dryer section comprising:

at least one top dryer group including a vapor permeable first woven fabric belt and at least one of a first plurality of dryer cylinders and a first plurality of rolls, said vapor permeable first woven fabric belt wrapping around said first plurality of dryer cylinders and forming a first endless loop; and a lower dryer group connected parallel to said at least one top dryer group, said lower dryer group including a vapor permeable second woven fabric belt and at least one of a second plurality of dryer cylinders and a second plurality of rolls, said vapor permeable second woven fabric belt wrapping around said second plurality of dryer cylinders and forming a second endless loop, said first and second woven fabric belts being driven in opposite directions relative to one another at an upstream first transfer location and at a downstream second transfer location, at said upstream first transfer location one of said first woven fabric belt and said second woven fabric belt being positionable and thereby moveable such that one of both said first and second woven fabric belts are in contact with one another and a distance is formed between said first and second woven fabric belts.

* * * * *